US012173449B2

(12) United States Patent
Erdebil et al.

(10) Patent No.: US 12,173,449 B2
(45) Date of Patent: Dec. 24, 2024

(54) FOLDED FABRIC CRUSHING MACHINE

(71) Applicant: BERTEKS TEKSTIL SANAYI VE TICARET ANONIM SIRKETI, Bursa (TR)

(72) Inventors: Burcu Erdebil, Bursa (TR); Osman Murat Erdebil, Bursa (TR)

( * ) Notice: Subject to any disclaimer, the term of this patent is extended or adjusted under 35 U.S.C. 154(b) by 171 days.

(21) Appl. No.: 18/051,684

(22) Filed: Nov. 1, 2022

(65) Prior Publication Data

US 2024/0141581 A1 May 2, 2024

(51) Int. Cl.
*D06J 1/02* (2006.01)

(52) U.S. Cl.
CPC ..... *D06J 1/02* (2013.01); *D10B 2503/02* (2013.01)

(58) Field of Classification Search
CPC ..... B65H 45/10; D06J 1/02; D10B 2503/02
See application file for complete search history.

(56) References Cited

U.S. PATENT DOCUMENTS

| | | | | | |
|---|---|---|---|---|---|
| 3,154,228 | A * | 10/1964 | Klint, Jr. | D06J 1/00 | 223/32 |
| 3,357,608 | A * | 12/1967 | Demagny | D06J 1/02 | 223/30 |
| 3,887,118 | A * | 6/1975 | Levenstein | D06J 1/06 | 223/28 |
| 7,465,267 | B2 * | 12/2008 | Goodrich | B65H 45/20 | 493/434 |
| 8,171,640 | B2 * | 5/2012 | Colson | B29C 66/437 | 29/897 |

FOREIGN PATENT DOCUMENTS

| | | | | |
|---|---|---|---|---|
| CN | 213624898 U | * | 7/2021 | |
| CN | 216335645 U | * | 4/2022 | |
| DE | 4429281 A1 | * | 3/1995 | D05B 33/00 |
| EP | 0222534 B1 | | 9/1991 | |
| JP | 2000070577 A | * | 3/2000 | |
| KR | 100811214 B1 | * | 3/2008 | |

* cited by examiner

*Primary Examiner* — F Griffin Hall
(74) *Attorney, Agent, or Firm* — Egbert, McDaniel & Swartz, PLLC

(57) ABSTRACT

A folded fabric crushing machine that makes it possible to produce curtain fabric, which is used in the production of multi-layered woven curtains used by connecting on fixed, movable or folding windows, doors and glass balconies, produced by multi-layered fabric weaving technique, without using adhesive material.

15 Claims, 5 Drawing Sheets

FOLDED FABRIC CRUSHING MACHINE

CROSS-REFERENCE TO RELATED APPLICATIONS

Not applicable.

BACKGROUND OF THE INVENTION

1. Field of the Invention

The invention relates to a folded fabric crushing machine used in the production of folded woven curtains used by connecting on all kinds of fixed, movable or folding windows, doors and glass balconies.

In particular, the invention relates to the folded fabric crushing machine, which enables the curtain fabric produced by the multi-layered fabric weaving technique to be produced without using adhesive material.

2. Description of Related Art Including Information Disclosed Under 37 CFR 1.97 and 37 CFR 1.98

Buildings are the longest-lasting and significant energy-consuming structures in the economy sector and cover a wide range of products and services; for this reason, they are considered as a priority work area in policies and programs aimed at increasing energy efficiency and climate change. It is stated that heat losses in buildings are from exterior walls (40%), windows (30%), doors (17%), roofs (7%) and floors (6%). At the same time, 50% of the undesired heat increase that occurs in the summer in houses is also comes through windows.

In the present technique, honeycomb curtain systems are widely used to create insulated surfaces like moving honeycombs used in front of windows. Honeycomb curtain systems are basically based on the principle of attaching two pleated fabrics to each other directly with the help of an adhesive or indirectly with a separate strip piece with adhesive feature. When two pleats of fabric are glued together, they complete the structure of the honeycomb.

In current practices, two fabrics are required to form the honeycomb structure. The fabrics are first given the hardness required for the pleat crushing process and then they are taken to the pleat crushing process. In both fabrics, after the desired pleat height is achieved, they are glued with the help of a machine. Until the honeycomb curtain takes its final form, the cost of weaving production of the two fabrics, the cost of dyeing (drying), the cost of crushing the pleat and the cost of the adhesive are incurred. In addition, the adhesive used in the process has its disadvantages. Due to the use of adhesive, both the production cost increases, and the adhesion property is lost over time due to the temperature formed on the curtain, and the honeycomb structure formed for air storage may deteriorate. This is an undesirable feature regarding the service life of honeycomb curtains.

The document numbered EP0222534, which was found in the research conducted in the literature, can be shown as an example of the prior art. The said document is about the honeycomb curtain production method with band-joined folded material. According to the method of forming the honeycomb structure of the said invention, a first continuous length of material is fed along its length and its opposite longitudinal edges are folded over one side of the material. This folded material is then aligned with a second material in the form of a strip which is fed into overlapping relationship with one side of the folded material. These aligned materials are then folded and wound in a continuous loop to form layers of strip material. These sheets are glued together by bonding the strip material to the facing surface of the next sheet of material. In the said invention, an adhesive is used as a binder for bonding strip materials to each other.

Therefore, the existence of the above problems and the inadequacy of the existing solutions made it necessary to make an improvement in the relevant technical field.

BRIEF SUMMARY OF THE INVENTION

The invention relates to a folded fabric crushing machine that eliminates the drawbacks mentioned above and provides new advantages to the related technical field.

The main purpose of the invention is to provide a folded fabric crushing machine that makes it possible to produce the curtain fabric produced by the multi-layered fabric weaving technique without using adhesive material.

The purpose of the invention is to provide folded fabric crushing machine so that the curtain fabric produced with the multi-layer fabric weaving technique can reach the consumer in a wide range of products by means of the increase in the number of honeycomb cells standing side by side of the curtain fabric.

Another purpose of the invention is to provide honeycomb curtains produced at low cost with the elimination of the use of adhesives.

In order to achieve all the objectives mentioned above and those that may arise from the detailed description, the invention is a folded fabric crushing machine that makes it possible to produce, without the use of adhesive, the curtain fabric produced by multi-layer fabric weaving technique material that is used in the production of multi-layer woven curtains used by connecting on all kinds of fixed, movable or folding windows, doors, glass balconies, characterized by comprising;

- a table with a flat metal sheet, on which the curtain fabric is treated for crushing,
- a crushing cylinder which allows the curtain fabric produced by the multilayer fabric weaving technique to be pleated by means of the lower crushing cylinder and the upper crushing cylinder,
- a thread pulling system which is located in the curtain fabric and allows the carrier guide ropes of equal tension or length affixed to the thread pulling cylinder for crushing process,
- a press system which allows the curtain fabric to be compressed into pleated shape,
- a reducer system with electric motor-driven reducer which allows the curtain fabric ready for the breaking process to be wrapped on it in the form of a fabric batch, feeding it to the layered fabric crushing machine at constant speed and tension without releasing back.

The structural and characteristic features of the invention and all its advantages will be understood more clearly by means of the figures presented below and the detailed description written by reference to these figures. For this reason, the evaluation should be made by considering these figures and the detailed description.

DESCRIPTION OF PART REFERENCES

Figure 1:
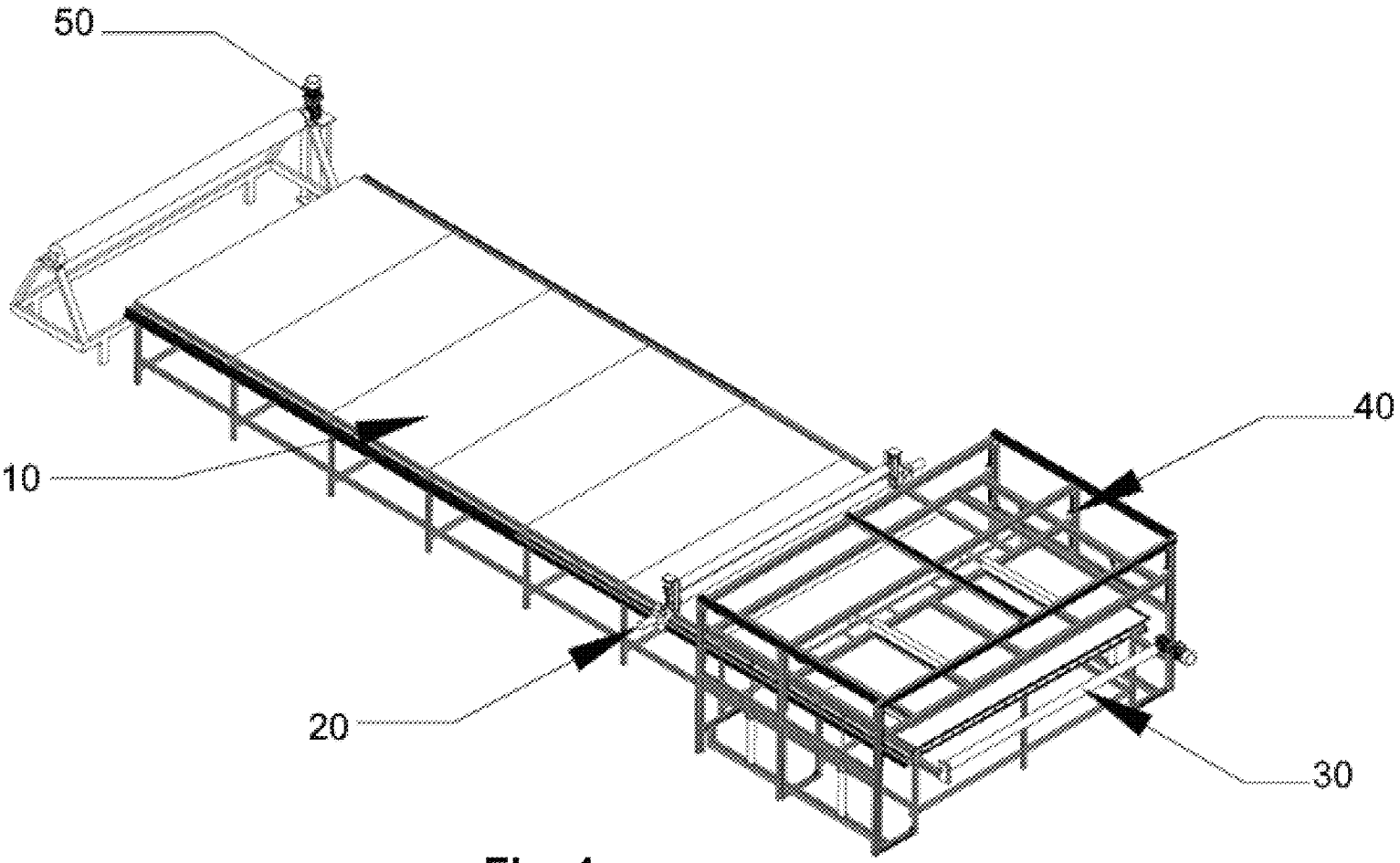
FIG. 1 is the perspective view of the folded fabric crushing machine, which is the subject of the invention.

10. Table
11. Table metal sheet
12. Body profile
13. Table rail
14. Table motion gear
15. Comber
20. Crushing cylinder system
21. Right main cylinder chassis
22. Left main cylinder chassis
23. Right and left vertical chassis
24. Crushing vertical pusher
25. Pusher upper cylinder connection
26. Ball bearing
27. Slide
28. Linear bearing
29. Pusher connection plate
291. Motion motor
292. Crushing motor
293. Motion gear
294. Lower crushing cylinder
295. Upper crushing cylinder
30. Thread pulling system
31. Thread pulling cylinder
32. Bearing
33. Thread pulling motor
40. Press system P
41. Press upper metal sheet
42. Horizontal press pusher
43. Horizontal press frame
44. Pusher frame body connection
45. Vertical press pusher
46. Horizontal press linear bearing
47. Horizontal press linear rail
48. Vertical press linear bearing
49. Vertical press linear rail
410. Vertical press frame
50. Reducer system
51. Reducer

DETAILED DESCRIPTION OF THE INVENTION

In this detailed description, the preferred alternatives of the folded fabric crushing machine, which is the subject of the invention, are explained only for a better understanding of the subject and without causing any limiting effect.

In FIG. 1, the representative view of the folded fabric crushing machine is given, which is the subject of the invention. Accordingly, in its most basic form the folded fabric crushing machine comprises a table (10), a crushing cylinder (20) that enables the curtain fabric produced by the multi-layered fabric weaving technique to be crushed into pleats, thread pulling system (30) for the crushing process of the carrier guide threads placed in the curtain fabric and glued on the thread pulling cylinder (31) with equal tension or length, the press system (40) which ensures that the curtain fabric is compressed into pleats, the reducer system (50) that ensures that the curtain fabric ready for breaking is wrapped on it as a fabric batch and fed to the folded fabric crushing machine at a constant speed and tension without releasing back.

Figure 2:
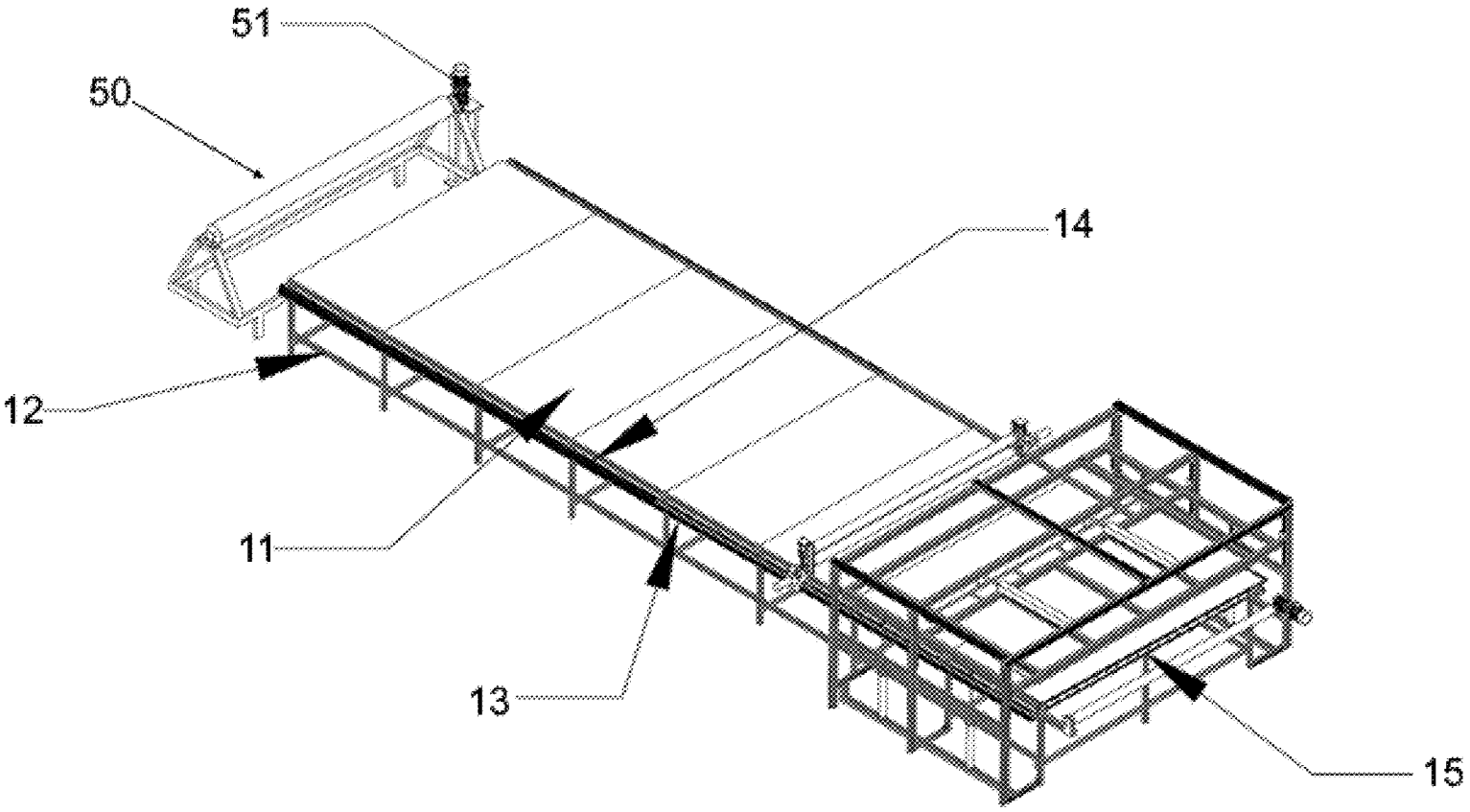
FIG. 2 is the perspective view of the folded fabric crushing machine, which is the subject of the invention.

As seen in FIG. 2, the table (10), which constitutes the main structure of the folded fabric crushing machine, which is the subject of the invention, has the table metal sheet (11) connected to the body profiles (12) and the body profiles (12), which basically form the body of the table (10). The said table metal sheet (11) is the flat area where the curtain fabric is processed for crushing. In order to prevent any deformation or contamination on the curtain fabric, the surface of the table metal sheet (11) must be smooth and resistant to corrosion. For this, the table metal sheet (11) is made of stainless steel. There are table rails (13) on both longitudinal edges of the table metal sheet (11) that provide the horizontal movement of the crushing cylinder system (20) on the table (10) and guide it to work stably with small tolerances. On one side of the table (10), preferably on the left, there is the table motion gear (14), which corresponds to the motion gear (293) located in the crushing cylinder system (20) and guides the crushing cylinder system (20) through its movement on the table rail (13).

There is a comber (15) at the front of the table (10) that acts as a guide for the carrier guide threads passing through the curtain fabric to be properly connected to the thread pulling cylinder (31) in the thread pulling system (30). The said comber (15) also acts as a front bumper in the press system (40) and acts as a bumper to keep the curtain fabric crushed on the table (10) while the carrier guide threads in the curtain fabric are pulled.

Figure 3:
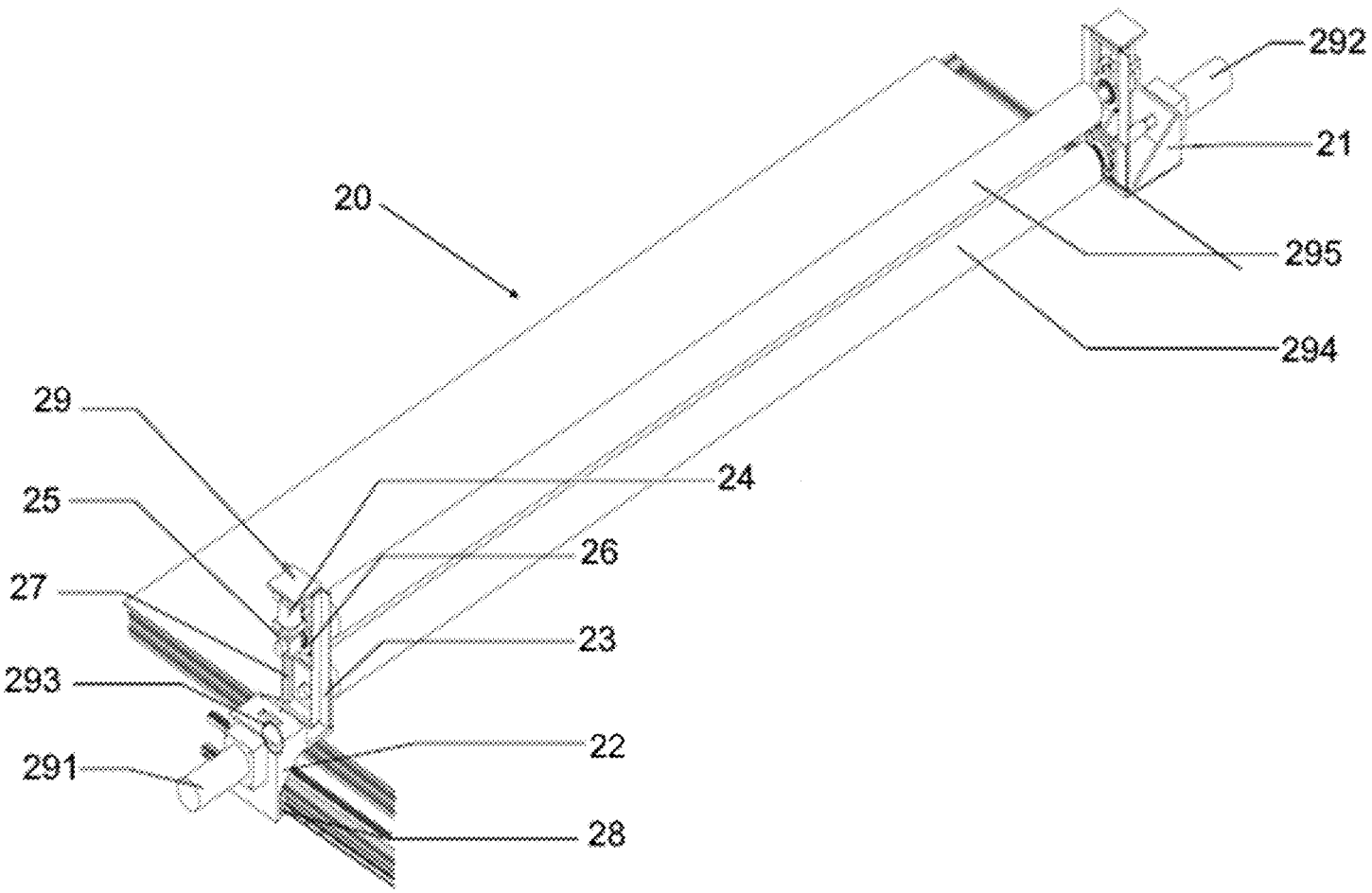
FIG. 3 is the detail view of the crushing cylinder system of the folded fabric crushing machine, which is the subject of the invention.

The crushing cylinder (20), which enables the curtain fabric produced by the multi-layered fabric weaving technique to be crushed into pleats by means of the lower crushing cylinder (294) and the upper crushing cylinder (295), basically comprises, as seen in FIG. 3, right main cylinder chassis (21) which is the right main body that connects the upper crushing cylinder (295) and provides the connection with the table (10) where the lower crushing cylinder (294) and the upper crushing cylinder (295) are connected and the left main cylinder chassis (22) which is the left main body that provides the connection with the table (10) where the lower crushing cylinder (294) and the upper crushing cylinder (295) are connected. The right and left vertical chassis (23) that provides the bearing of the lower crushing cylinder (294) and the upper crushing cylinder (295) are connected to the right main cylinder chassis (21) and left main cylinder chassis (22) mentioned above. On the right and left vertical chassis (23), there is the vertical pusher (24) that provides the movement of the lower crushing cylinder (294) and the upper crushing cylinder (295) on the right and left vertical chassis (23) and adjusts the compression ratio of the curtain fabric. When the said lower crushing cylinder (294) and upper crushing cylinder (295) are in the closed position, the curtain fabric is compressed and crushed by passing through, or the curtain fabric is provided to pass easily when it is in the open position. The pusher upper cylinder connection (25) is connected to the right and left vertical chassis (23) by means of the pusher connection plate (29). The said pusher upper cylinder connection (25) transmits the pushing movement to the lower crushing cylinder (294) and upper crushing cylinder (295). The upper crushing cylinder (295) provides its movement on the slides (27) located on the right and left vertical chassis (23), by means of a ball bearing (26). The said ball bearing (26) also provides the axial rotation of the upper crushing cylinder (295). The slides (27), located on the right and left vertical chassis (23), provide stable movement to the ball bearing (26).

The right main cylinder chassis (21) and the left main cylinder chassis (22) move on the table rail (13) on the table (10) by means of a linear bearing (28).

The motion of the lower crushing cylinder (294) is provided by the crushing motor (292) on the right main cylinder chassis (21). At the same time, the motion of the lower crushing cylinder (294) and the upper crushing cylinder (295) on the horizontal axis on the table (10) is provided by the motion motor (291) on the left main cylinder chassis (22). The said motion motor (291) works simultaneously with the crushing motor (292) and ensures that the curtain fabric is crushed at optimum speed and quality. The motion gear (293), which is associated with the motion motor (291), moves on the table motion gear (14) with the drive it receives from the motion motor (291) and provides the horizontal movement of the lower crushing cylinder (294) and the upper crushing cylinder (295) on the table (10).

The lower crushing cylinder (294) rotates in the crushing direction with the drive it receives from the motion motor (291), and together with the pressure of the upper crushing cylinder (295), crushes the curtain fabric. The rotation speed of the lower crushing roller (294) and the horizontal movement speed on the table (10) are simultaneous.

The upper crushing cylinder (295), together with the pressure it exerts on the lower crushing cylinder (294), ensures that the curtain fabric is crushed with its free rotation movement as it passes between them and the lower crushing cylinder (294).

Figure 4:
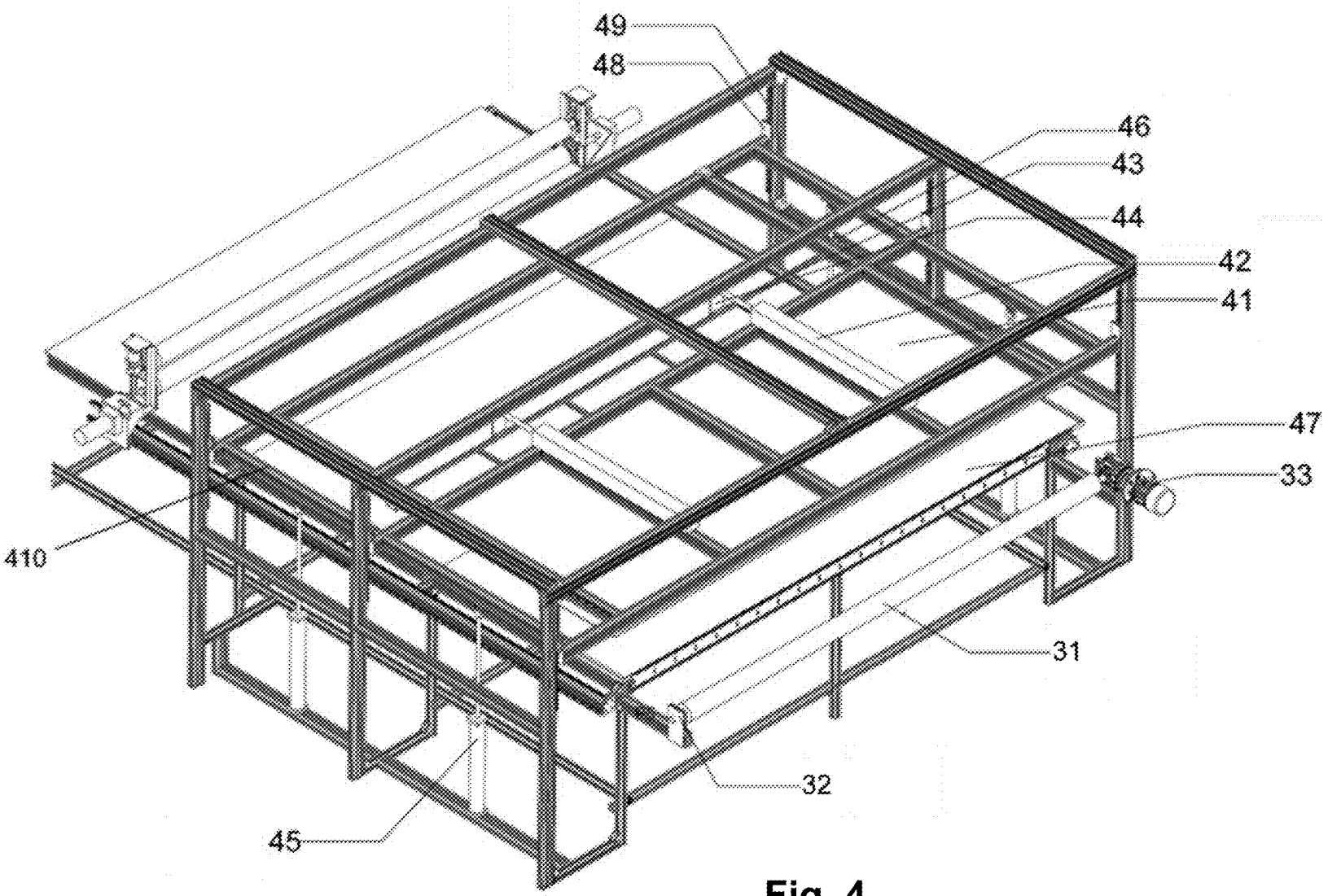
FIG. 4 is the view of the thread pulling system and press system of the folded fabric breaking machine, which is the subject of the invention.
Figure 5:
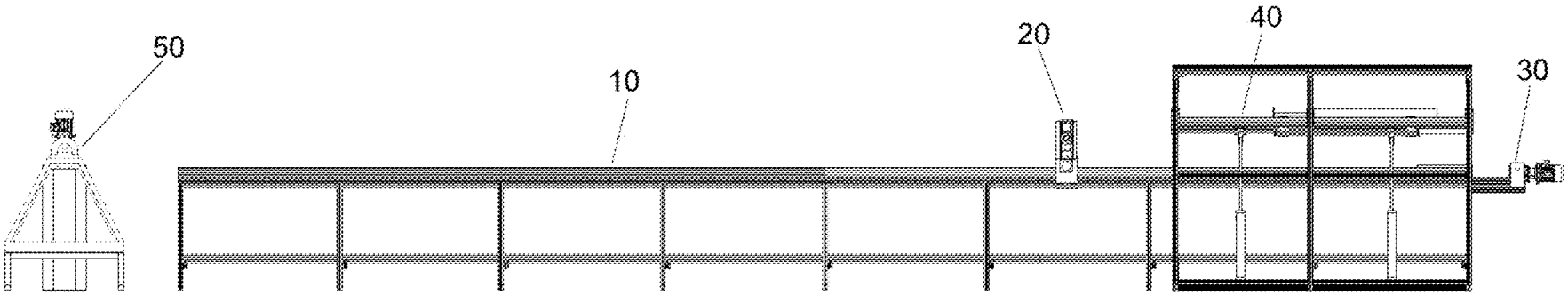
FIG. 5 is the side view of the folded fabric crushing machine which is the subject of the invention.

The thread pulling system (30) which ensures that the carrier guide threads inside the curtain fabric that are attached to the thread pulling cylinder (31) with equal tension or length, are pulled for the crushing process, when the thread is attached to the carrier guide threads inside the curtain fabric, as seen in FIG. 4, has a thread pulling cylinder (31) that enables the carrier guide threads to be pulled through the curtain fabric by the drive of the thread pulling motor (33). The said thread pulling cylinder (31) is connected to the table (10) by means of the bearing (32).

The press system (40) that compresses the curtain fabric in a pleated manner is seen in FIG. 4; the press system (40) basically has a press top metal sheet (41) that comes into contact with the upper surface of the curtain fabric and exerts the top pressure. On the upper side of the press top metal sheet (41), there is the horizontal press pusher (42) and the horizontal press frame (43), which applies horizontal compression on the crushed fabric. The horizontal press pusher (42) and the horizontal press frame (43) are connected to each other by means of the pusher frame body connection (44). A vertical press pusher (45) is attached to the right and left sides of the table (10), which applies the top pressure on the crushed curtain fabric and also lifts the pressing system (40) to a certain height on the vertical axis for comfortable working while the pre-adjustment is being made on the front of the table (10).

The horizontal press frame (43) is supported on the table (10) by means of the horizontal press linear bearing (46) and it moves on the horizontal press linear rail (47) on the horizontal press linear bearing (46). The vertical press frame (410) is supported on the table (10) by means of the vertical press linear bearing (48), and it moves on the vertical press linear rail (49) on the vertical press linear bearing (48).

The reducer system (50), which enables the curtain fabric ready for crushing process to be wound in the form of a fabric batch and fed to the folded fabric crushing machine at a constant speed and tension without releasing back, basically has a reducer (51) driven by an electric motor. It ensures that the curtain fabric advances with the tension determined on the table metal sheet (11) and there is no back-release.

The principle of operation of the folded fabric crushing machine, which is the subject of the invention, is as follows:

The fabric, which is produced with the multi-layered fabric weaving technique, is wrapped on the reducer system (50) and connected to the folded fabric crushing machine by means of the reducer (51). The curtain fabric is passed between the lower crushing cylinder (294) and the upper crushing cylinder (295) and is pulled up to the comber (15) located on the table sheet (11) at the front of the folded fabric crushing machine. Then, the carrier guide threads inside the curtain fabric are passed through the comber (15) in a way that one thread will come to each eye and they are tied, that is, bonded, to the thread pulling cylinder (31) in such a way that all the threads are at the same tension. Afterwards, the thread pulling motor (33) is operated to ensure that a certain amount of the curtain fabric is crushed behind the comber at the front of the folded fabric crushing machine. The thread pulling motor (33) operates synchronously with the reducer (51). Then, the crushing cylinder system (20) is positioned at the closest distance to the fabric entry point of the folded fabric crushing machine.

The lower crushing cylinder (294) and the upper crushing cylinder (295) are lowered to press with their own weight with the help of the crushing vertical pusher (24). Then, the crushing motor (292) and the motion motor (291) are started synchronously. As the crushing cylinder system (20) moves towards the exit side of the folded fabric crushing machine, the curtain fabric passing between the lower crushing cylinder (294) and the upper crushing cylinder (295) begins to be crushed at the inlet side of the folded fabric crushing machine. This crushing continues until all the fabric starts to peel off from the carrier guide threads.

After all the fabric is crushed, the crushed fabric is transferred to the exit side of the folded fabric crushing machine with the help of the thread pulling cylinder (31). First, the crushed fabric is pressed with the help of the vertical press pusher (45). Then, in order to fix the shape given to the fabric and to compress and pack it perfectly, with the help of the horizontal press pusher (42) the crushed fabric is pressed against the comber (15) with the help of the horizontal press frame (43) and it is completely compressed. Then, the carrier guide threads are completely pulled through the fabric and cleaned. After all these processes, the curtain fabric is locked in a special metal box and dried in special ovens. After this hot drying process, the crushed folded fabric is packed in cardboard boxes and it becomes ready for sale.

We claim:

1. A folded fabric crushing machine for producing a curtain fabric without using adhesive, the folded fabric crushing machine comprising:

a table having a flat metal sheet adapted to treat the curtain fabric for crushing;

a crushing cylinder having a lower crushing cylinder and an upper crushing cylinder, said crushing cylinder adapted to allow the curtain fabric to be pleated;

a threaded pulling system adapted to be positioned in the curtain fabric, said threaded pulling system having carrier guide ropes of equal tension or length affixed thereto;

a press system adapted to allow the curtain fabric to be compressed into a pleated shape;

a reducer system having an electric motor-driven reducer adapted to allow the curtain fabric to be wrapped thereon in a fabric batch form, said reducer system adapted to feed the curtain fabric at a constant speed and tension without releasing back;

a motion motor connected to the lower crushing cylinder and the upper crushing cylinder so as to move the lower crushing cylinder and the upper crushing cylinder along a horizontal axis on said table; and a motion gear cooperative with said motion motor so as to move on a table motion gear so as to drive the table motion gear by the motion motor so as to horizontally move the lower crushing cylinder and the upper crushing cylinder on said table.

2. The folded fabric crushing machine of claim 1, further comprising:

a body profile forming a body of said table, said body profile connected to the flat metal sheet.

3. The folded fabric crushing machine of claim 1, further comprising:

a table rail positioned on opposite longitudinal edges of the flat metal sheet, said table rail adapted to provide horizontal movement of said crushing cylinder on said table and to guide said crushing cylinder.

4. The folded fabric crushing machine of claim 3, further comprising:

a right main cylinder chassis having a right main body that connects the lower crushing cylinder to the upper crushing cylinder, said right main cylinder chassis being connected to said table, said right main cylinder chassis being movable on a linear bearing on said table rail on said table.

5. The folded fabric crushing machine of claim 4, further comprising:

a left main cylinder chassis having a left main body that connects the lower crushing cylinder to the upper crushing cylinder, said left main cylinder chassis being connected to said table and movable along another linear bearing on said table rail on said table.

6. The folded fabric crushing machine of claim 5, further comprising:

a right and left vertical chassis positioned on said right main cylinder chassis and said left main cylinder chassis, said right and left vertical chassis providing a bearing for the lower crushing cylinder and the upper crushing cylinder.

7. The folded fabric crushing machine of claim 6, further comprising:

a crushing vertical pusher positioned on said right and left vertical chassis so as to move the lower crushing cylinder and the upper crushing cylinder.

8. The folded fabric crushing machine of claim 6, further comprising:

a pusher upper cylinder connection connected to said right and left vertical chassis by a pusher connection plate, said pusher upper cylinder connection transmitting a pushing movement to the lower crushing cylinder and the upper crushing cylinder.

9. The folded fabric crushing machine of claim 1, wherein said table motion gear is positioned on one side of said table so as to correspond with said motion gear so as to guide said crushing cylinder during horizontal movement on said table.

10. The folded fabric crushing machine of claim 1, further comprising:

a comber positioned at a front of said table so as to guide the carrier guide ropes for connection to a thread pulling cylinder of said threaded pulling system, said comber adapted to keep the crushed curtain fabric on said table while the carrier guide ropes are pulled.

11. The folded fabric crushing machine of claim 1, further comprising:

a crushing motor cooperative with the lower crushing cylinder so as to move the lower crushing cylinder.

12. The folded fabric crushing machine of claim 1, wherein said threaded pulling system has a thread pulling cylinder mounted on said table by a bearing, the thread pulling cylinder adapted to cause the carrier guide ropes to be pulled through the curtain fabric by at least one thread pulling motor.

13. The folded fabric crushing machine of claim 1, wherein said press system has a press upper metal sheet adapted to contact an upper surface of the curtain fabric so as to press the upper surface of the curtain fabric.

14. The folded fabric crushing machine of claim 13, further comprising:

a horizontal press pusher and a horizontal press frame positioned on an upper side of the press upper metal sheet and adapted to ensure a horizontal compression of the crushed fabric, said horizontal press pusher and the horizontal press frame being connected to each other by a pusher frame body connection.

15. The folded fabric crushing machine of claim 1, further comprising:

a vertical press pusher positioned on a right side and a left side of said table, said vertical press pusher adapted to apply a top pressure to the crushed curtain fabric while raising said press system to a height along a vertical axis.

* * * * *